United States Patent [19]

Martinez

[11] 4,225,173

[45] Sep. 30, 1980

[54] CABLE RETRIEVING TOOL

[76] Inventor: Ruben C. Martinez, 403 - 35th, Snyder, Tex. 79549

[21] Appl. No.: 9,679

[22] Filed: Feb. 5, 1979

[51] Int. Cl.[3] ..... E21B 31/00

[52] U.S. Cl. ..... 294/86.1

[58] Field of Search ..... 294/86.1, 86.11, 86.12, 294/86.14, 86.24, 86.25, 86.26, 86.28, 86.29, 86.32, 86.34, 61; 166/99, 101, 170, 173, 174, 241

[56] References Cited

U.S. PATENT DOCUMENTS

| | | | |
|---|---|---|---|
| 1,790,387 | 1/1931 | Monroe | 294/86.1 |
| 2,231,919 | 2/1941 | Kent | 294/86.1 |
| 3,039,530 | 6/1962 | Condra | 166/173 |

*Primary Examiner*—James B. Marbert

*Attorney, Agent, or Firm*—Wendell Coffee

[57] ABSTRACT

A cable retrieving tool has helically arranged blades periodically terminating in teeth. Once the cable to be retrieved is engaged the tool is rotated as it is lowered to more securely grapple the cable by the teeth before it is withdrawn from the well.

9 Claims, 3 Drawing Figures

CABLE RETRIEVING TOOL

BACKGROUND OF THE INVENTION (1) Field of the Invention

This invention relates to wells, more specifically to the retrieving of cable from the wells.

(2) Description of the Prior Art

There has long been a problem in the maintenance of oil and gas wells with the recovering of cable and tools lost down the well. Steel cable or wire line is commonly used at drilling sites to lower tools, etc. into the well. Clearly, great lengths of cable must be used. From time to time this cable breaks while it is being raised. When the cable breaks it sinks toward the bottom of the well. Those who are operating the well are faced with either fishing the cable out of the well or drilling a new well altogether. The drilling of a new well is clearly a very expensive alternative. However, in many oilfield operations "time is money" and time spent trying to retrieve the cable could well end up being more expensive. Considerable time may be wasted in trying to withdraw the cable as the cable is very likely to break again as it is drawn up. Also, it may be practically impossible to retrieve the cable by methods in use before this invention.

The actual fishing procedure includes inserting the tool into the well and lowering it by successive lengths of tubing until it comes into contact with the cable. Once the cable has been located or engaged, it must be grasped or grappled or attached by the tool and withdrawn from the well. Problems arise both in the initial attachment step and in keeping the cable securely held as it is pulled out of the well.

Before filing this application, applicant caused a search of the prior art to be made in the United States Patent and Trademark Office. That search produced the following U.S. Pat. Nos.:

Barnes—3,895,837;
Blume—3,330,533;
Sonnier—3,029,098;
Monroe—1,790,387;
Hanlon—1,490,386;
Lower—985,817.

LOWER discloses a corkscrew like fishing tool which is primarily useful for retrieving valves from oil wells. While spiralling members are disclosed, the engaging members are pronged, not threaded.

BARNES and MONROE both disclose fishing spears with the engaging teeth axially aligned on the mandrel.

BLUME discloses a tool with axially oriented engaging hooks which are used in duct cleaning.

The other references discovered by the searcher are of general interest only, and believed to be not as pertinent as those discussed above.

SUMMARY OF THE INVENTION (1) New and Different Function

I have invented a tool to more efficiently retrieve cable and tools which are lost down wells. The design of my tool facilitates a twisting or rotating motion which allows a more secure attaching or engaging of the cable. Much of the frustration of knowing where the cable is yet not being able to grasp it with the tool is alleviated by my invention, as the twisting motion effects a screwing of the cable into the threads between the engaging blades.

(2) Objects of this Invention

An object of this invention is to more efficiently fish cable and tools from wells.

Further objects are to achieve the above with a device that is sturdy, compact, durable, lightweight, simple, safe, efficient, versatile, ecologically compatible, energy conserving, and reliable, yet inexpensive and easy to manufacture, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
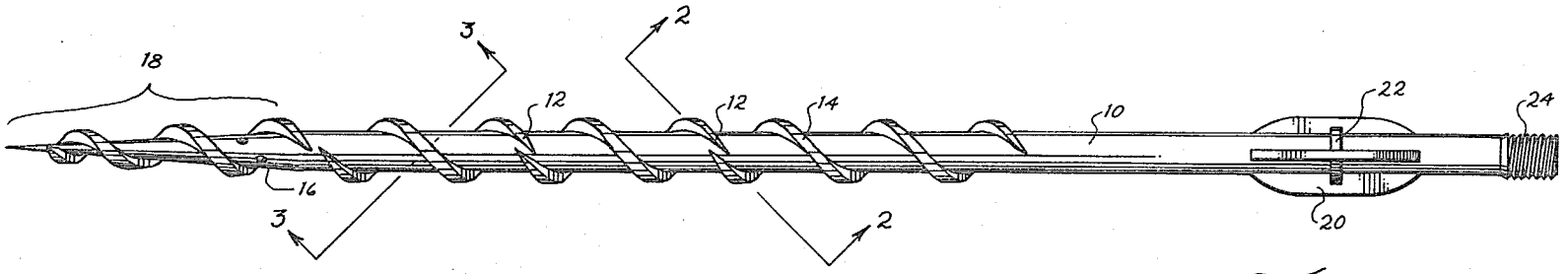
FIG. 1 is a side elevational view of an embodiment of my invention.
Figure 3:
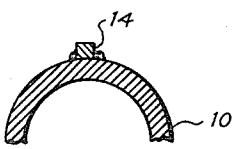
FIG. 3 is a sectional view taken substantially along line 3—3.

Referring to the drawing, there may be seen a cable retrieving tool. The tool includes tubular mandrel 10. Oriented about the mandrel 10 are helixed blades 14. Blades 14 are rectangular in cross section (FIG. 3). One side of the blade is welded to the mandrel 10 while the inner side angles upward such that cable may be wedged between the blade and mandrel (FIG. 3). The blades periodically terminate in engaging teeth 12. The blades 14 may be thought of as a single blade which is interupted rather than plural blades which terminate.

The lower end of the mandrel 10 tapers into cone configuration 18. This cone configuration facilitates the easier lowering of the tool into the well as well as grappling the cable. Near the cone, drain holes 16 may be seen. These holes are common in the art. A centering guide means is located near the upper end of the mandrel. The guide means is made up of two elements, fin-like radial guide plates 20 and reinforcement plates 22. The guide plates 20 are attached to the mandrel as by welding. The reinforcement plates run perpendicularly between the guide plates, about the circumference of the mandrel 10. The reinforcement plates 22 are shorter in height than the guide plates so that fluids may pass by and the tool will be more easily lowered into the well. The reinforcement plates too are fixed to the mandrel by welding. The guide plates 20 are for centering the tool in the casing or pipe.

Machined threads 24, located at the end of the mandrel 10 opposite the cone configuration, are used to attach the tool to sections of tubing which lower the tool into the well. The guide means is adjacent the threads 24.

This tool will obviously be manufactured in varying sizes to fit different sized wells. Choosing the correct sized tool is simply a matter of selecting the tool which has a diameter, measured through the guide plates, which is just smaller than the pipe into which the tool is to be inserted.

Figure 2:
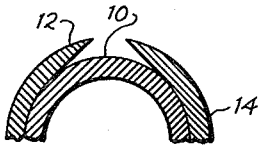
FIG. 2 is a sectional view taken substantially along line 2—2.

As the tool is lowered into the well hole, fluids pass into the bore of the mandrel through drain holes 16. This influx of fluid keeps the tool from floating as well as keeping it from collapsing due to high pressure at great depths. The guide plates 20 keep the tool in the middle of the pipe as it descends. Once the tool comes into contact with the cable to be retrieved, it is rotated slowly in a clockwise motion. As the tool is turned, it is lowered slowly. After contacting the cable, the tool is lowered approximately seven feet (the overall length of the tool). The twisting motion screws the tool into the cable and allows secure engaging of the cable by wedging in the teeth. At each interuption of the blade 14, the blade angles outward from the mandrel forming tooth 12 as seen in FIG. 2. After the cable is engaged, the tool and cable are carefully withdrawn.

As an aid to correlating the terms of the claims to the exemplary drawing, the following catalog of elements is provided:

| | |
|---|---|
| 10 mandrel | 18 cone configuration |
| 12 engaging teeth | 20 guide plate |
| 14 helixed blade | 22 reinforcement plates |
| 16 drain hole | 24 machined threads |

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. In a cable retrieving tool having a. a mandrel, b. said mandrel tapering into a cone configuration at one end, c. said mandrel being threaded at the end opposite said cone configuration, the improved structure for engaging cable comprising:

d. a blade helixed about said mandrel e. said blade periodically terminating in engaging teeth.

2. The invention as defined in claim 1 further comprising:

f. a centering guide attached to said mandrel.

3. The invention as defined in claim 2 wherein said centering guide means are fin-like guide plates.

4. The invention as defined in claim 1 further comprising:

f. said blades are rectangular shaped material with one side against the mandrel and welded thereto.

5. The invention as defined in claim 1 further comprising:

f. the inner surface of said blades are angled outward from the mandrel at each termination of a segment of the blade, thus forming teeth whereby g. the cable may be wedged by the teeth between the blade and mandrel.

6. The invention as defined in claim 5 further comprising:

h. said blades are rectangular shaped material with one side against the mandrel and welded thereto.

7. The invention as defined in claim 1 further comprising:

j. a centering guide attached to said mandrel.

8. The invention as defined in claim 7 wherein said centering guide means are fin-like guide plates.

9. In a fishing procedure for retrieving broken cable from within wells including a. lowering a tool into the well, b. engaging the cable to be retrieved on the tool, and c. withdrawing the tool and cable from the well;

the improved method comprising the steps of:

d. grappling said cable by e. rotating the tool as it is lowered, thus f. screwing the tool into the cable.

* * * * *